US011607902B2

(12) United States Patent
Roudaut et al.

(10) Patent No.: US 11,607,902 B2
(45) Date of Patent: Mar. 21, 2023

(54) NIB FOR WRITING FELT PEN

(71) Applicant: SOCIETE BIC, Clichy (FR)

(72) Inventors: Etienne Roudaut, Clichy (FR); Arnaud Bez, Clichy (FR)

(73) Assignee: SOCIÉTÉ BIC, Clichy (FR)

( * ) Notice: Subject to any disclaimer, the term of this patent is extended or adjusted under 35 U.S.C. 154(b) by 86 days.

(21) Appl. No.: 17/082,836

(22) Filed: Oct. 28, 2020

(65) Prior Publication Data

US 2021/0122182 A1 Apr. 29, 2021

(30) Foreign Application Priority Data

Oct. 29, 2019 (EP) ..... 19306403

(51) Int. Cl.

| | |
|---|---|
| ***B43K 1/12*** | (2006.01) |
| ***B43K 8/02*** | (2006.01) |
| ***B43K 8/03*** | (2006.01) |
| ***B43K 3/00*** | (2006.01) |

(52) U.S. Cl.

CPC ..... *B43K 1/12* (2013.01); *B43K 3/00* (2013.01); *B43K 8/024* (2013.01); *B43K 8/03* (2013.01)

(58) Field of Classification Search

CPC ..... B43K 1/003; B43K 1/006; B43K 1/12; B43K 8/00; B43K 8/003; B43K 8/02; B43K 8/022; B43K 8/024; B43K 8/026; B43K 8/028; B43K 8/12

See application file for complete search history.

(56) References Cited

U.S. PATENT DOCUMENTS 3,421,823 A * 1/1969 Hiroyuki ..... B43K 8/02 401/199
4,749,618 A * 6/1988 Kawaguchi ..... B43K 1/12 428/397

(Continued)

FOREIGN PATENT DOCUMENTS

EP 2889153 A1 * 7/2015 ..... B43K 1/003
FR 2750646 A1 1/1998

(Continued)

OTHER PUBLICATIONS

Extended European Search Report dated Apr. 23, 2020 in counterpart European Patent Application No. 19306403.7 (8 pages, in English).

*Primary Examiner* — David P Angwin
*Assistant Examiner* — Bradley S Oliver
(74) *Attorney, Agent, or Firm* — Bookoff McAndrews, PLLC

(57) ABSTRACT

A nib for a valve-free free ink writing felt pen including a first end configured to deliver ink to a writing support and second end, opposite the first end, configured to be inserted in a nib receiving part of the valve-free free ink writing felt pen, the first end and the second end defining an axial direction of the nib, the nib having an external surface configured to cooperate with an internal surface of the nib receiving part, the external surface being configured to allow intake of air from the outside of a free ink tank, the valve-free free ink writing felt pen into the free ink tank and avoid ink leakage outside the free ink tank when cooperating with the internal surface of the nib receiving part. A valve-free free ink writing felt pen including a nib.

17 Claims, 3 Drawing Sheets

(56) References Cited

U.S. PATENT DOCUMENTS

| | | | | | |
|---|---|---|---|---|---|
| 4,838,723 | A * | 6/1989 | Suzuki | B43K 1/12 401/265 |
| 6,644,880 | B2 | 11/2003 | Duez et al. | |
| 10,336,129 | B2 * | 7/2019 | Nakajima | B43K 17/005 |

FOREIGN PATENT DOCUMENTS

| | | | | |
|---|---|---|---|---|
| WO | 2014176092 | A1 | 10/2014 | |
| WO | WO-2014176092 | A1 * | 10/2014 | B43K 1/12 |
| WO | 2015046861 | A1 | 4/2015 | |

* cited by examiner

NIB FOR WRITING FELT PEN

CROSS REFERENCE TO RELATED APPLICATION(S)

This application claims priority to European patent application No. EP19306403.7 filed on Oct. 29, 2019, the entire contents of which is incorporated herein by reference.

TECHNICAL FIELD

The present disclosure is related to valve-free free ink writing felt pen, and more particularly to a nib for a valve-free free ink writing felt pen.

BACKGROUND

A free ink writing felt pen is felt pen in which the ink is free to move in the ink tank. In free ink writing felt pen, ink used for writing has to be replaced by air in the ink tank.

Baffles are known, which are made of a succession of lamellas. Baffles allow the ink to flow without leaking and air exchange to ensure air balance between the inside of ink tank and the atmosphere outside the ink tank. As the afore-mentioned air balance is maintained by the baffles, there is no need for an air hole being present in the writing instrument.

Free ink writing felt pen with valves controlling the flow of ink are also known.

However, it might remain desirable to increase the autonomy of the free ink writing felt pen and simplifying its production, while avoiding leakage of ink and ensuring good flow of ink outside of the ink tank when writing with the free ink writing felt pen.

SUMMARY

Therefore, according to embodiments of the present disclosure, a nib for a valve-free free ink writing felt pen is provided. A valve-free free ink writing felt pen is defined as a felt pen in which the nib itself acts as a baffle. This eliminates the use of traditional baffles (as described in the above section), making the felt pen more reliable and/or less complex to manufacture. The nib may include a first end configured to deliver ink to a writing support and a second end, opposite the first end, configured to be inserted in a nib receiving part of the valve-free free ink writing felt pen, the first end and the second end defining an axial direction of the nib, the nib having an external surface configured to cooperate with an internal surface of the nib receiving part, the external surface being configured to allow intake of air from the outside of a free ink tank of the valve-free free ink writing felt pen into the free ink tank and avoid ink leakage outside the free ink tank when cooperating with the internal surface of the nib receiving part.

The external surface may present micro-reliefs configured to act as baffle. More specifically, the internal surface of the nib receiving part cooperates with the micro-reliefs of the external surface of the nib so as to form a plurality of spaces between the nib and the nib receiving part, wherein the plurality of spaces may be configured to act as baffle, i.e. the plurality of spaces may allow the free ink to flow from the free ink tank without leaking and air exchange to ensure air balance between the inside of free ink tank and the atmosphere outside the free ink tank. More specifically as the plurality of spaces allow the ink to flow from the ink tank, these spaces are connected one to another (interconnected plurality of spaces).

The nib may include a plurality of sections having different diameters and connected to one another by flared sections, each section being configured to cooperate with the nib receiving part so as to form an annular space, the plurality of annular spaces being configured to act as baffle.

The diameter may be measured in a radial direction, which is perpendicular to the axial direction.

The nib may be a sintered powder nib.

The sintered powder nib may include polypropylene or polyethylene, or a mixture thereof.

The nib may include fibers agglomerated by a resin.

The fibers may include polyester, acrylic, polyamide or polyacrylonitrile, or a mixture thereof and the resin may include polyurethane or urea aminoplast, or a mixture thereof.

The nib may be an extruded nib.

The extruded nib may include polyacetal, polypropylene or polyethylene, or a mixture thereof.

The present disclosure also provides a valve-free free ink writing felt pen. The valve-free free ink writing felt pen includes a free ink tank, a nib receiving part and an above-defined nib, the nib receiving part having an internal surface cooperating with the external surface of the nib to allow intake of air from the outside of the free ink tank of the valve-free free ink writing felt pen into the free ink tank and avoid ink leakage outside the free ink tank. More specifically, the external surface of the nib cooperates with an internal surface of the nib receiving part in order to act as a baffle, i.e. allowing the free ink to flow from the free ink tank without leaking and air exchange to ensure air balance between the inside of free ink tank and the atmosphere outside the free ink tank. In particular, as the external surface is configured to allow intake of air from the outside of a free ink tank of the valve-free free ink writing felt pen into the free ink tank and to avoid ink leakage outside the free ink tank when cooperating with the internal surface of the nib receiving part, there is no need for an air hole being present in the writing instrument.

The internal surface of the nib receiving part may cooperate with the micro-reliefs so as to form a plurality of spaces between the nib and the nib receiving part, the plurality of spaces being configured to act as baffle.

The nib may be a sintered powder nib and the spaces may have a dimension, measured in a radial direction perpendicular to the axial direction, equal to or greater than 105% time the diameter of the powder, specifically equal to or greater than 110%.

The nib may be a sintered powder nib and the spaces may have a dimension, measured in a radial direction perpendicular to the axial direction, equal to or smaller than 150% time the diameter of the powder.

The nib may include fibers agglomerated by a resin and the spaces may have a dimension, measured in a radial direction perpendicular to the axial direction, equal to or greater than 105% time the diameter of the fibers, specifically equal to or greater than 110%.

The nib may include fibers agglomerated by a resin and the spaces may have a dimension, measured in a radial direction perpendicular to the axial direction, equal to or smaller than 150% time the diameter of the fibers.

The internal surface of the nib receiving part may have a plurality of sections having different diameters and connected to one another by flared sections, each section of the nib cooperating with one section of the nib receiving part so as to form an annular space, the plurality of annular spaces being configured to act as baffle.

The nib receiving part may include one or more axial abutment element of the nib into the nib receiving part.

It is intended that combinations of the above-described elements and those within the specification may be made, except where otherwise contradictory.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles thereof.

DETAILED DESCRIPTION

Reference will now be made in detail to exemplary embodiments of the disclosure, examples of which are illustrated in the accompanying drawings. Wherever possible, the same reference numbers will be used throughout the drawings to refer to the same or like parts.

Figure 1:
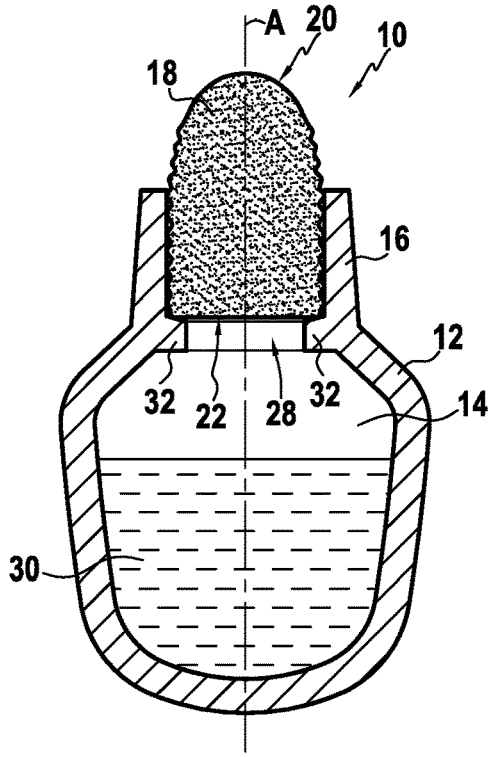
FIG. 1 shows a representation of an exemplary a valve-free free ink writing felt pen.

FIG. 1 shows a representation of an exemplary valve-free free ink writing felt pen 10 according to embodiments of the present disclosure. The valve-free free ink writing felt pen 10 may include a body 12. The body 12 may include a free ink tank 14 and a nib receiving part 16. The valve-free free ink writing felt pen 10 may include a nib 18. The nib 18 may include a first end 20 configured to deliver ink to a writing support and second end 22, opposite the first end 20. The second end 22 may be inserted in the nib receiving part 16 of the valve-free free ink writing felt pen 10.

As shown on FIG. 1, the first end 20 and the second end 22 may define an axial direction A of the nib 18. The axial direction A is also the axial direction of the valve-free free ink writing felt pen 10.

As shown on FIG. 1, the free ink tank 14 may include free ink 30.

The body 12 may also include a feeding passage 28 allowing the free ink 30 to flow from the free ink tank 14 to the second end 22 of the nib 18 and through the nib 18 to the first end 20 of the nib 18 and to a writing support.

The nib receiving part 16 may include an axial abutment element 32 of the nib 18 into the nib receiving part 16. The axial abutment element 32 allows limiting the insertion along the axial direction A of the nib 18 into the nib receiving part 16.

As shown on FIG. 1 and as a non-limiting example, the axial abutment element 32 may be circumferential, i.e., be continuous in a circumferential direction and have a general annular shape.

Alternatively, as shown on FIG. 1 and as a non-limiting example, the nib receiving part 16 may include more than one axial abutment element 32 of the nib 18 into the nib receiving part 16, in particular an even number of abutment elements 32, for example four, disposed at regular interval, the view of FIG. 1 cutting through two opposed axial abutment elements 32.

Figure 4:
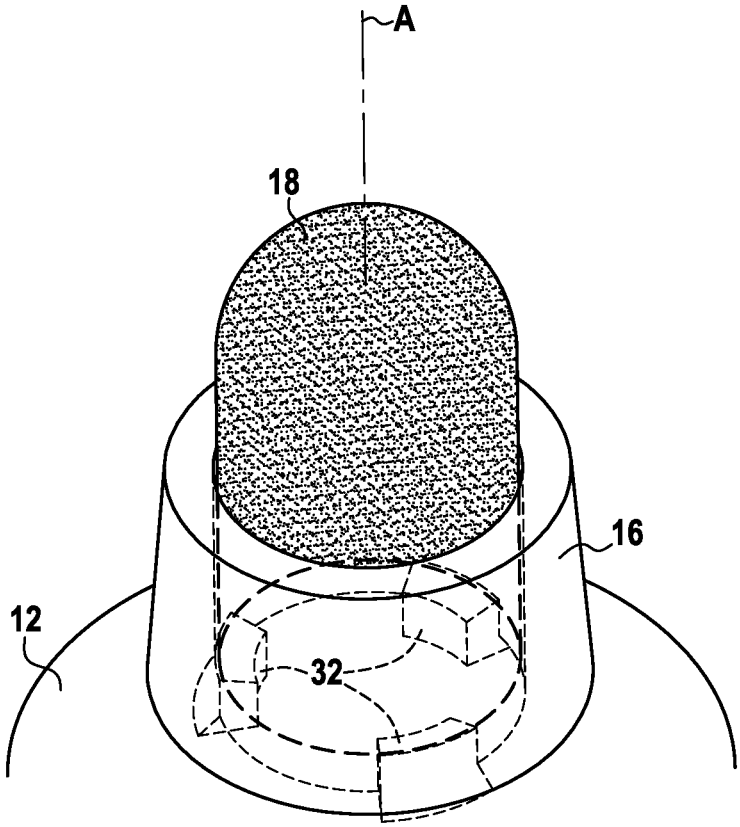
FIG. 4 shows a partial perspective view of another exemplary valve-free free ink witting felt pen.

As shown on FIG. 4, the nib receiving part 16 may include more than one axial abutment element 32 of the nib 18 into the nib receiving part 16. As a non-limiting example, the nib receiving part 16 may include three axial abutment elements 32. For better comprehension, the nib 18 has been represented in transparency thus showing the three axial abutment elements 32. It is understood that the number of axial abutment elements is not limited to the examples shown on FIGS. 1 and 4.

As a non-limiting example, the free ink 30 may be a water-based free ink and the nib may be made of a hydrophilic material.

As a non-limiting example, the water-based free ink 30 may present a surface tension between 5 mN/m (millinewton per meter) and 100 mN/m.

Figure 2:
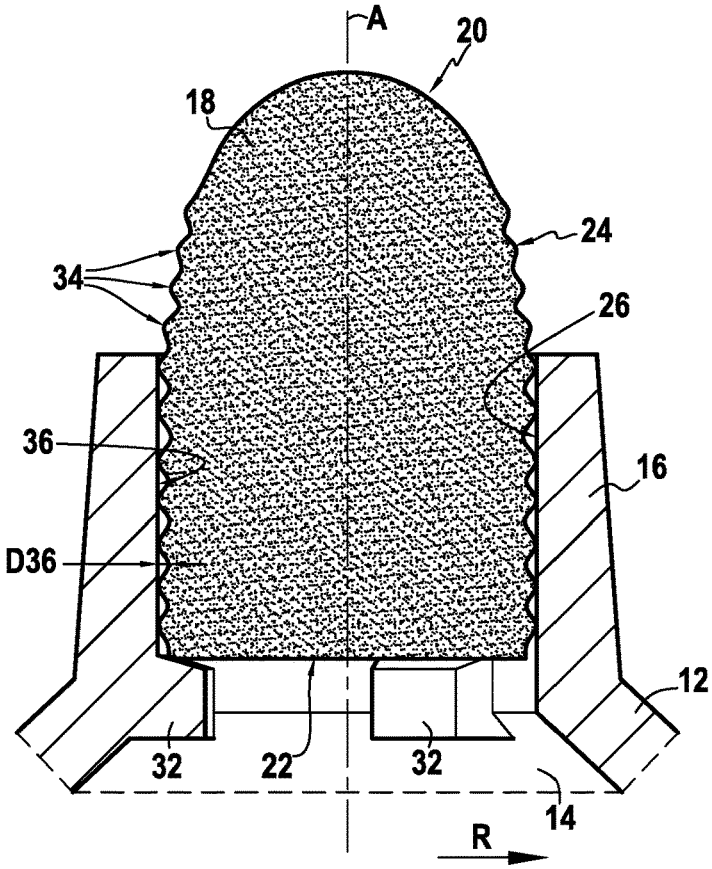
FIG. 2 shows an enlarged partial view of another exemplary valve-free free ink writing felt pen.

As shown on FIG. 2, the nib 18 may have an external surface 24. The external surface 24 may cooperate with an internal surface 26 of the nib receiving part 16 to allow intake of air from the outside of the free ink tank 14 of the valve-free free ink writing felt pen 10 into the free ink tank 14 and avoid ink leakage outside the free ink tank 14.

As a non-limiting example, the external surface 24 of the nib 18 may present micro-reliefs 34. It is understood that the micro-reliefs 34 are different from surface roughness. The micro-reliefs 34 may be present on the external surface 24 of the nib 18, the first end 20 being free of micro-reliefs 34.

The nib 18 may be obtained by sintering powder particles in a mold. The nib 18 may be a sintered powder nib.

As non-limiting examples, the micro-reliefs 34 may be obtained by a single sintering/molding step with micro texture on an internal surface of the sintering mold, by a machining step of the nib 18 after the sintering step in the sintering mold, by a chemical attack to modify the texture of the nib, by compression of the sintered powder nib in another mold having a textured surface, by a single sintering/molding step with a gradient of granulometry of the powder on the external surface 24 of the nib 18 between the first end 20 and the second end 22.

As non-limiting examples, the sintered powder nib may include polypropylene or polyethylene or a mixture thereof.

The nib 18 may be obtained by agglomerating fibers with a resin.

As non-limiting examples, the micro-reliefs 34 may be obtained by a single molding step with micro texture on an internal surface of the mold, by a machining step of the nib 18 after the molding step in the mold, by a chemical attack to modify the texture of the nib 18, by compression of the nib in another mold having a textured surface, by a single molding step with a gradient of fiber size on the external surface 24 of the nib 18 between the first end 20 and the second end 22.

As non-limiting examples, the fibers may include polyester, acrylic, polyamide or polyacrylonitrile or a mixture thereof and the resin may include polyurethane or urea aminoplast or a mixture thereof.

The nib 18 may be obtained by extruding the material to form the nib 18. The nib 18 may be an extruded nib.

As non-limiting examples, the micro-reliefs 34 may be obtained by a machining step of the nib 18 after the molding step in the mold, by a chemical attack to modify the texture of the nib 18, by compression of the nib in another mold having a textured surface, by a gradient of fiber size between the external surface 24 of the nib 18 and the center of the nib 18.

As non-limiting examples, the extruded nib may include polyacetal, polypropylene or polyethylene or a mixture thereof.

As shown on FIG. 2, when the nib 18 is inserted into the nib receiving part 16 of the body 12, the external surface 24 of the nib 18 may cooperate with the internal surface 26 of the nib receiving part 16. The internal surface 26 of the nib receiving part 16 may cooperate with the micro-reliefs 34 of the external surface 24 of the nib 18 so as to form a plurality of spaces 36 between the nib 18 and the nib receiving part 16, the plurality of spaces 36 may act as baffle, i.e., the plurality of spaces 36 may allow the free ink 30 to flow from the free ink tank 14 without leaking and air exchange to ensure air balance between the inside of free ink tank 14 and the atmosphere outside the free ink tank 14.

As a non-limiting example, the spaces 36 may have a dimension D36, measured in a radial direction R perpendicular to the axial direction A, equal to or greater than 105% time the diameter of the powder, when the nib 18 is made of sintered powder.

As a non-limiting example, the spaces 36 may have a dimension D36, measured in a radial direction R perpendicular to the axial direction A, equal to or greater than 110% time the diameter of the powder, when the nib 18 is made of sintered powder.

As a non-limiting example, the spaces 36 may have a dimension D36, measured in a radial direction R perpendicular to the axial direction A, equal to or smaller than 150% time the diameter of the powder, when the nib 18 is made of sintered powder.

As a non-limiting example, the powder may present a diameter between 2 μm (micrometer) and 200 μm.

As a non-limiting example, the spaces 36 may have a dimension D36, measured in the radial direction R perpendicular to the axial direction A, equal to or greater than 105% time the diameter of the fibers, when the nib 18 is made fibers agglomerated by a resin.

As a non-limiting example, the spaces 36 may have a dimension D36, measured in the radial direction R perpendicular to the axial direction A, equal to or greater than 110% time the diameter of the fibers, when the nib 18 is made fibers agglomerated by a resin.

As a non-limiting example, the spaces 36 may have a dimension D36, measured in the radial direction R perpendicular to the axial direction A, equal to or smaller than 150% time the diameter of the fibers, when the nib 18 is made fibers agglomerated by a resin.

As a non-limiting example, the fibers may present a diameter between 10 μm and 200 μm.

As a non-limiting example, the dimension D36 of the spaces 36 may be equal to or greater than 20 μm and equal to or smaller than 2 mm.

Figure 3:
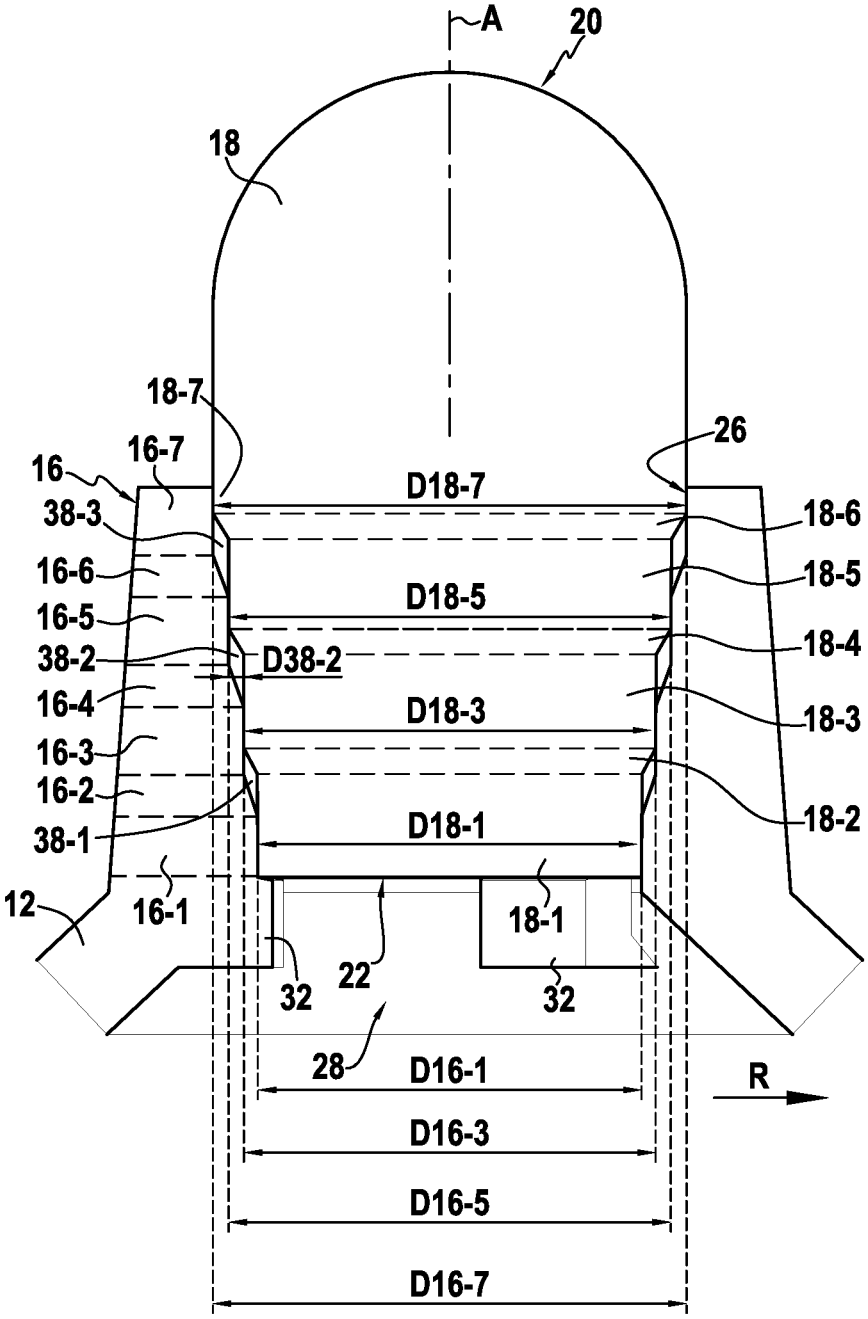
FIG. 3 shows an enlarged partial view of another exemplary valve-free free ink writing felt pen.

FIG. 3 shows another valve-free free ink writing felt pen 10 according to embodiments of the present disclosure.

As shown on FIG. 3, the nib 18 may have an external surface 24. The external surface 24 may cooperate with an internal surface 26 of the nib receiving part 16 to allow intake of air from the outside of the free ink tank 14 of the valve-free free ink writing felt pen 10 into the free ink tank 14 and avoid ink leakage outside the free ink tank 14.

As a non-limiting example, the external surface 24 of the nib 18 may include a plurality of sections 18-1, 18-3, 18-5, 18-7, having a general cylindrical form, each section 18-1, 18-3, 18-5, 18-7 presenting a different diameter D18-1, D18-3, D18-5, D18-7, respectively. The sections 18-1, 18-3, 18-5, 18-7 may be connected to one another by flared sections 18-2, 18-4, 18-6.

As a non-limiting example, the internal surface 26 of the nib receiving part 16 may have a plurality of sections 16-1, 16-3, 16-5, 16-7 having a general cylindrical form, each section 16-1, 16-3, 16-5, 16-7 presenting a different diameter D16-1, D16-3, D16-5, D16-7 and connected to one another by flared sections 16-2, 16-4, 16-6.

As a non-limiting example, when the nib 18 is inserted into the nib receiving part 16, the external surface 24 of each section 18-1 to 18-7 of the nib 18 cooperating with one section 16-1 to 16-7 of the nib receiving part 16 so as to form an annular space 38-1, 38-2, 38-3, the plurality of annular spaces 38-1, 38-2, 38-3 being configured to act as baffle.

As shown on FIG. 3, the annular space 18-2 may have a maximum dimension D18-2, measured in the radial direction R perpendicular to the axial direction A. The same applies to the annular space 18-1 and 18-3.

As a non-limiting example, the maximum dimension D38-2 of the annular space 38-2 may be equal to or greater than 20 μm and equal to or smaller than 2 mm. The same applies to the maximum dimension D38-1 of the annular space 38-1 and the maximum dimension D38-3 of the annular space 38-3.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A valve-free free ink writing felt pen comprising:

a free ink tank;

a nib; and a nib receiving part, the nib receiving part having an internal surface cooperating with an external surface of the nib to allow intake of air from outside of the free ink tank of the valve-free free ink writing felt pen into the free ink tank and avoid ink leakage outside the free ink tank;

wherein the nib includes:

a first end configured to deliver ink to a writing support and a second end, opposite the first end, configured to be inserted in the nib receiving part of the valve-free free ink writing felt pen, the first end and the second end defining an axial direction of the nib, the nib external surface configured to cooperate with an internal surface of the nib receiving part to act as a baffle, the external surface being configured to allow intake of air from the outside of a free ink tank of the valve-free free ink writing felt pen into the free ink tank and avoid ink leakage outside the free ink tank when cooperating with the internal surface of the nib receiving part, and wherein the nib comprises a plurality of sections having different diameters and connected to one another by flared sections, each section being configured to cooperate with the nib receiving part so as to form an annular space, the plurality of annular spaces being configured to act as a baffle, wherein the internal surface of the nib receiving part has a plurality of sections having different diameters and connected to one another by flared sections, each section of the nib cooperating with one section of the nib receiving part so as to form an annular space, the plurality of annular spaces being configured to act as a baffle.

2. The pen according to claim 1, wherein the external surface presents micro-reliefs configured to act as a baffle, whereby the internal surface of the nib receiving part cooperates with the micro-reliefs of the external surface of the nib so as to form a plurality of spaces between the nib and the nib receiving part, more specifically the plurality of spaces allowing the free ink to flow from the free ink tank without leaking and air exchange to ensure air balance between an inside of the free ink tank and the atmosphere outside the free ink tank.

3. The pen according to claim 2, wherein a dimension of the spaces being equal to or greater than 20 μm and equal to or smaller than 2 mm.

4. The pen according to claim 1, wherein the nib is a sintered powder nib that comprises polypropylene or polyethylene.

5. The pen according to claim 1, wherein the nib comprises fibers agglomerated by a resin.

6. The pen according to claim 5, wherein the fibers present a diameter between 10 μm and 200 μm.

7. The pen according to claim 5, wherein the fibers comprise polyester, acrylic, polyamide or polyacrylonitrile and the resin comprises polyurethane or urea aminoplast.

8. The pen according to claim 1, wherein the nib is an extruded nib that comprises polyacetal, polypropylene or polyethylene.

9. The pen according to claim 1, wherein the external surface presents micro-reliefs configured to act as a baffle, whereby the internal surface of the nib receiving part cooperates with the micro-reliefs of the external surface of the nib so as to form a plurality of spaces between the nib and the nib receiving part, more specifically the plurality of spaces allowing the free ink to flow from the free ink tank without leaking and air exchange to ensure air balance between an inside of the free ink tank and the atmosphere outside the free ink tank, the plurality of spaces being configured to act as baffle.

10. The pen according to claim 9, wherein a dimension of the spaces being equal to or greater than 20 μm and equal to or smaller than 2 mm.

11. The pen according to claim 10, wherein the nib is a sintered powder nib and the spaces have a dimension, measured in a radial direction perpendicular to the axial direction, equal to or greater than 105% time the diameter of the powder.

12. The pen according to claim 10, wherein the nib comprises fibers, which comprise a diameter between 10 μm and 200 μm, and are agglomerated by a resin and the spaces have a dimension, measured in a radial direction perpendicular to the axial direction, equal to or greater than 105% the diameter of the fibers.

13. The pen of claim 1, wherein the nib receiving part comprises one or more axial abutment elements for limiting axial insertion of the nib into the nib receiving part.

14. A valve-free free ink writing felt pen comprising:

a free ink tank, a nib receiving part, and a nib comprising:

a first end configured to deliver ink to a writing support and a second end, opposite the first end, configured to be inserted in the nib receiving part of the valve-free free ink writing felt pen, the first end and the second end defining an axial direction of the nib, the nib having an external surface configured to cooperate with an internal surface of the nib receiving part to act as a baffle, the external surface being configured to allow intake of air from the outside of the free ink tank of the valve-free free ink writing felt pen into the free ink tank and avoid ink leakage outside the free ink tank when cooperating with the internal surface of the nib receiving part, and wherein the nib comprises a plurality of sections having different diameters, the plurality of sections connected to one another by flared sections, at least some of the sections being configured to cooperate with the nib receiving part so as to form an annular space, the plurality of annular spaces of the cooperating sections being configured to act as baffle, wherein the internal surface of the nib receiving part has a plurality of sections having different diameters and connected to one another by flared sections, such that at least some of the sections of the nib cooperate with at least some sections of the nib receiving part so as to form a plurality of annular spaces, the plurality of annular spaces being configured to act as baffle.

15. A valve-free free ink writing pen comprising:

a nib comprising:

a first end;

a second end opposite the first end;

a longitudinal axis between the first end and the second end; and an external surface comprising a plurality of micro-reliefs;

a nib receiving part comprising:

an internal surface;

wherein the nib contacts the nib receiving part discontinuously in a direction parallel to the longitudinal axis of the nib to form a plurality of spaces between the micro-reliefs of the external surface of the nib and the internal surface of the nib receiving part such that the micro-reliefs form a baffles allowing ink to transfer from a free ink tank to the first end of the nib through the nib without leaking from the free ink tank.

16. The valve-free free ink writing pen of claim 15, wherein the nib receiving part further comprises one or more axial abutment elements protruding radially inwardly from an internal wall of the nib receiving part for at least a portion of a radius of a feeding passage between the free ink tank and the nib.

17. The valve-free free ink writing pen of claim 16, wherein the feeding passage is an open passage such that free ink can directly contact the second end of the nib when the longitudinal axis of the valve-free free ink writing pen is tilted.

* * * * *